United States Patent [19]

Meier, Jr.

[11] Patent Number: 5,018,895

[45] Date of Patent: May 28, 1991

[54] FILM STACKER CLIP

[76] Inventor: Joseph A. Meier, Jr., 9440 Hoffman Way, #D302, Thornton, Colo. 80229

[21] Appl. No.: 420,403

[22] Filed: Oct. 12, 1989

[51] Int. Cl.[5] ..... B42F 3/02; B42F 13/30

[52] U.S. Cl. ..... 402/4; 281/15.1; 281/51; 402/20; 402/21; 402/15; 402/48; 402/80 P; 402/68

[58] Field of Search ..... 402/20, 21, 48, 68, 402/80 R, 80 P, 15, 22, 4; 251/15.1, 51

[56] References Cited

U.S. PATENT DOCUMENTS

| | | | |
|---|---|---|---|
| 1,829,613 | 10/1931 | Sato | 402/15 |
| 2,844,848 | 7/1958 | Smith | 402/80 P X |
| 2,937,834 | 5/1960 | Orenick et al. | 402/80 P X |
| 3,087,498 | 4/1963 | Vogel | 402/80 P X |
| 3,246,653 | 4/1966 | Sexton | 402/15 |
| 3,757,389 | 9/1973 | Wiland | 402/68 X |
| 3,970,331 | 7/1976 | Giulie | 281/21 |
| 4,340,316 | 7/1982 | Jahn | 402/80 P X |
| 4,607,970 | 8/1986 | Heusinkveld | 402/20 |

OTHER PUBLICATIONS

"Mechanical Binding", Acquaviva, J.; Xerox Disclosure Journal; vol. 1, No. 2; Feb., 1976.

*Primary Examiner*—Paul A. Bell

*Attorney, Agent, or Firm*—Henderson & Sturm

[57] ABSTRACT

A film stacker clip arrangement (10) for a stack (100) of sheets of film (101) or flats having aligned apertures (102) wherein the arrangement (10) includes a plurality of clip units (11) having a male member (15) and a female member (12) connected by a flexible strap element (21) so as to captively engage the stack (100) of film along at least one edge.

3 Claims, 1 Drawing Sheet

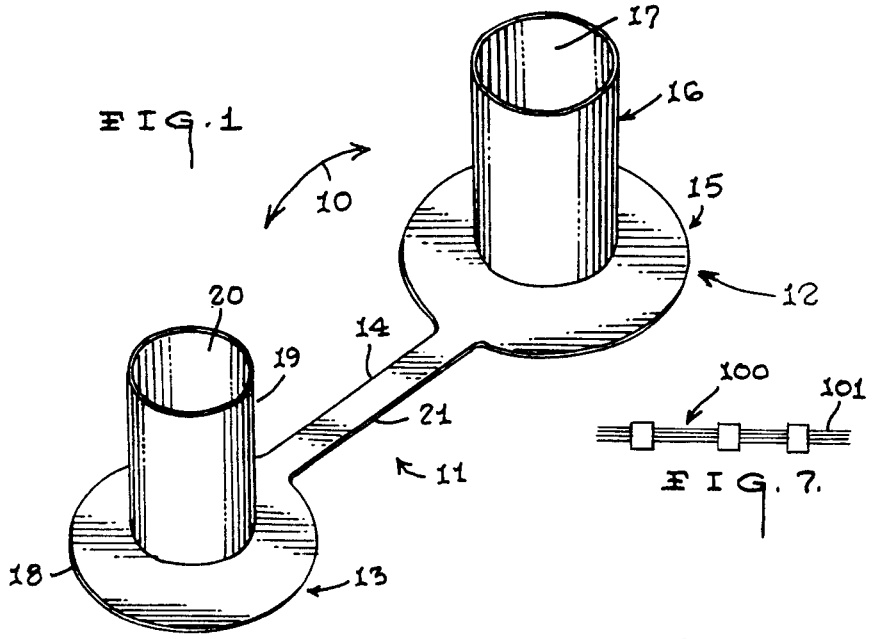
FIG. 1
FIG. 7.
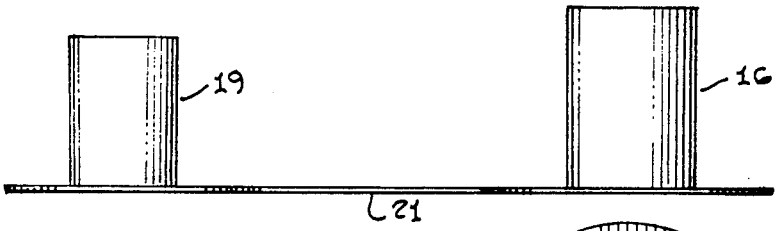
FIG. 2.
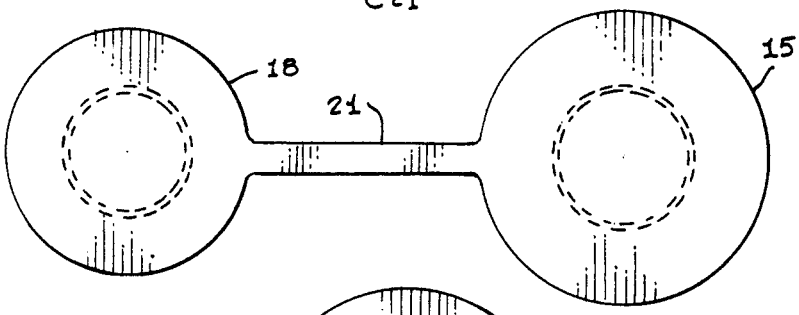
FIG. 3.
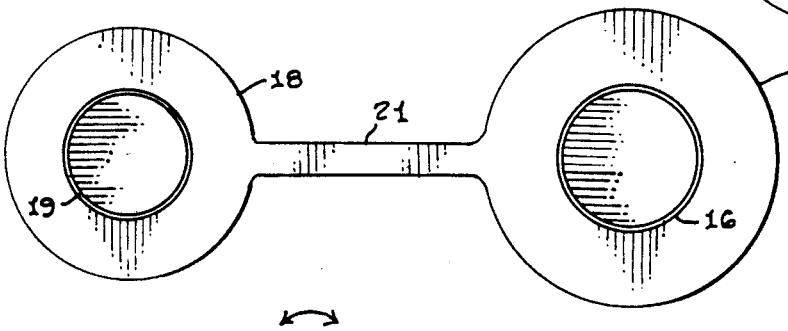
FIG. 4.
FIG. 6.
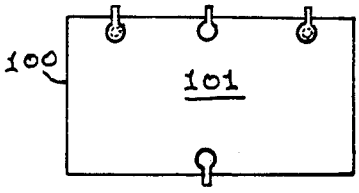
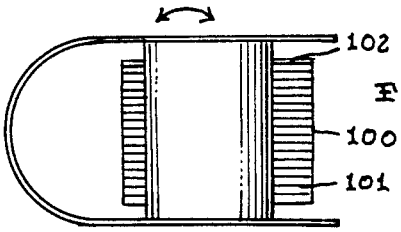
FIG. 5.

FILM STACKER CLIP

TECHNICAL FIELD

This invention relates to binding devices in general, and more particularly to a binding device for the purpose of holding litho camera, stripping, films, flats and plates together.

BACKGROUND OF THE INVENTION

Previous binding devices have been concerned with the holding of perforated sheets or the like. This can be seen by reference to the following U.S. Pat. No's.: 1,829,613; 3,246,653; 4,607,970; and, 3,970,331. All of these prior art devices solve the problem of binding paper together but do not address the specialized problems that are encountered when binding film and/or plates together.

A stack of film needs to be bound in a firm and secure manner to decrease the sliding of one sheet of film against the other, which produces scratches and destroys the quality of the film or flats. A need exists therefore for a binder that will hold film and plates in a secure and safe manner.

Most printing companies store their films and flats and plates anywhere from two to five years. This is due to the fact of the likelihood of the customer reordering the same films and flats again for their next job. For the storage of these films and flats the printing companies do not use albums because albums are too big and bulky. In most shops they either stack the film and flats loosely or place them in folders. By storing the plates and film in this manner they can be easily damaged or destroyed by sliding against one another. Noting the high probability of customers reordering the same job, keeping the films in good shape will almost eliminate the increased cost of restripping the job or even replating the job for the printing company.

As a consequence of the foregoing situation there has existed a longstanding need among those individuals who have encountered this particular problem in the past; and the provision of such a device to solve this problem is a stated objective of the present invention.

SUMMARY OF THE INVENTION

The object of this invention is to provide a device that will hold film, flats and plates together in a neat and safe fashion while not taking up too much space in the process.

The present invention comprises a film stacker clip device that would fit loosely but snugly into discrete holes punched into the side of the film by a standard hole puncher and would clip together by the use of a male pin with tapered sides which would plug into the hollow and tapered female side of the clip.

Due to the tapering and tight fit when the male pin is inserted into the female pin this arrangement would remain engaged until an external force separated the two elements. Since the pins in the preferred embodiment are dimensioned to fit snugly within the punched holes, there would be very little play between the pin and the film.

The operative disposition of the individual clips relative to the film is such that the clips are disposed at spaced locations along at least one side of the film. In addition, another clip may be disposed on the opposite side of the film to guarantee that the film will be safely secured.

The fastening of the film as described above would make the film act or move as a single unit, making it easy to handle and store; while protecting the film from damage that can easily occur by the film sliding back and forth on top of one another.

The film clips relatively small size will also make it easier for the person using the film or flats to store his film safely while using the smallest amount of space possible. Each clip of the preferred embodiment is dimensioned so that it can store complete jobs for forms depending on the size of the job. This device may also be made out of a material such as plastic enabling the film clip to be lightweight and inexpensive to produce.

BRIEF DESCRIPTION OF THE DRAWING

These and other objects, advantages and novel features of the invention will become apparent from the detailed description of the best mode for carrying out the preferred embodiment of the invention; particularly when considered in conjunction with the accompanying drawings, wherein:

FIG. 1 is an isolated perspective view of an individual film clip;

FIG. 2 is a side view of the film clip;

FIG. 3 is a bottom view;

FIG. 4 is a top view;

FIG. 5 is a side view of the individual film clip disposed in its engaged configuration;

FIG. 6 is a top view of the invention in use in its intended environment, and, FIG. 7 is a side view of the invention in its intended environment.

BEST MODE FOR CARRYING OUT THE INVENTION

As can best be seen by reference to the drawings and in particular to FIG. 1, the film stacker clip arrangement that forms the basis of the present invention is designated generally by the reference numeral (10). The film stacker clip arrangement (10) further comprises a plurality of individual clip units (11). These units will now be described in seriatim fashion.

As can best be seen in FIG. 1, each of the individual clip units (11) comprises three distinct portions: a female member (12); a male member (13); and an intermediate connector member (14). These components of the connector unit (11) will also be described in seriatim fashion.

Turning now to FIGS. 1 thru 4, it can be seen that the female member (12) comprises a generally flat circular female base element (15) having an elongated hollow female cylindrical element (16) which projects upwardly from the female base element (15); wherein the female cylindrical element (16) has an inwardly tapered internal wall surface (17).

Still referring to FIGS. 1 thru 4, it can be seen that the male member (13) comprises a generally flat circular male base element (18) having a reduced diameter elongated male cylindrical element (19) which projects upwardly from the male base element (18); wherein the male cylindrical element (18) has an inwardly tapered external surface (20) which is complementary to the inwardly tapered internal wall surface (17) of the female cylindrical element (16).

In the preferred embodiment of the arrangement (10) illustrated in the drawings, it can be seen that the male cylindrical element (18) is depicted as a hollow body; however, it should also be appreciated that should rigidity be required, that the male cylindrical element (18) may be fabricated as a solid cylindrical body (not shown).

Still referring to FIGS. 1 thru 4, it can be seen that the intermediate connector member (14) forms the operative connection between the male member (13) and the female member (12); wherein, the intermediate connector member (14) comprises an elongated relatively thin flexible strap element (21) having one end connected to the male member (13) and having the other end connected to the female member (12).

As can be seen particularly by reference to FIG. 5, the flexible strap element (21) acts as a flexible hinge so as to allow for mating engagement between the male cylindrical element (18) and the female cylindrical element (16). In addition, it should also be noted that the height of the respective cylindrical elements (16) and (18) dictates the number of individual sheets of film (101) or flats (not shown) that can be formed into a stack (100).

As can be seen particularly by reference to FIGS. 5 thru 7, each of the individual sheets of film (101) are provided with a plurality of aligned punched apertures (102) which are formed adjacent to he periphery of at least one edge of the sheets of film (101) wherein the apertures (102) are formed by a conventional hole punch (not shown).

In addition, in the preferred embodiment of the invention the film stacker clip arrangement (10) involves a plurality of individual clip units (11) disposed at spaced locations along one edge of the film stack (100) and a single clip unit (11) disposed along the opposite edge of the film stack (100) which may or may not be there.

Having thereby described the subject matter of this invention, it should be obvious that many substitutions, modifications and variations of the invention are possible in light of the above teachings. It is therefore to be understood that the invention as taught and described herein is only to be limited to the extent of the breadth and scope of the appended claims.

I claim:

1. A film stacker clip arrangement in combination with a stack of individual sheets of film having a plurality of aligned apertures of predetermined diameter formed along at least one side of the sheets of film; wherein, the clip arrangement consists of:

a plurality of clip units wherein each of the clip units comprises a male cylindrical member and female cylindrical member operatively connected by an intermediate connector member;

wherein, the female member is dimensioned to be received in one of the said plurality of aligned apertures in the stack of film in a snugly fitting manner such that the individual sheets of film will be restrained from relative lateral movement with respect top one another;

wherein, the female cylindrical member comprises: a generally enlarged flat circular female base element; and an enlarged diameter elongated hollow female cylindrical element dimensioned to provide for a snug fit within said aligned apertures; and the male cylindrical member comprises: a generally enlarged flat circular male base element; and a reduced diameter elongated cylindrical male element;

and, wherein the intermediate connector member comprises an elongated generally flat flexible strap element connected on opposite ends to and having a width substantially smaller than the generally enlarged flat circular male and female base elements.

2. The arrangement as in claim 1; wherein, the elongated cylindrical male element is hollow.

3. The arrangement as in claim 1; wherein, the elongated cylindrical male element is solid.

* * * * *